United States Patent [19]

Otsuka et al.

[11] 4,364,359

[45] Dec. 21, 1982

[54] CONTROL SYSTEM FOR INTERNAL COMBUSTION ENGINES, HAVING FUNCTION OF DETECTING ABNORMALITIES IN ENGINE SPEED SIGNAL DETECTING SYSTEM

[75] Inventors: Kazuo Otsuka, Higashikurume; Shin Narasaka, Yono; Shumpei Hasegawa, Niiza, all of Japan

[73] Assignee: Honda Motor Co., Ltd., Tokyo, Japan

[21] Appl. No.: 290,847

[22] Filed: Aug. 7, 1981

[30] Foreign Application Priority Data

Aug. 14, 1980 [JP] Japan ..... 55-112522

[51] Int. Cl.[3] ..... F02G 3/00; F02M 7/00

[52] U.S. Cl. ..... 123/440; 123/494

[58] Field of Search ..... 123/440, 489, 494; 60/276, 285

[56] References Cited

U.S. PATENT DOCUMENTS

| | | | |
|---|---|---|---|
| 3,942,493 | 3/1976 | Linder et al. | 123/440 |
| 4,105,726 | 8/1978 | Lindberg | 123/440 |
| 4,131,088 | 12/1978 | Reddy | 123/494 |
| 4,136,645 | 1/1979 | Ao et al. | 123/440 |
| 4,181,108 | 1/1980 | Belliardi | 123/440 |
| 4,239,028 | 12/1980 | Kinata et al. | 123/440 |
| 4,279,230 | 7/1981 | Bauer et al. | 123/440 |
| 4,287,864 | 9/1981 | Takada et al. | 123/440 |
| 4,290,404 | 9/1981 | Hata et al. | 123/440 |

*Primary Examiner*—Raymond A. Nelli

*Attorney, Agent, or Firm*—Arthur L. Lessler

[57] ABSTRACT

A control system for use with an internal combustion engine, which includes a timer for producing a trouble indicative signal when there is continued over a predetermined period of time a concurrence of a first signal produced when the pressure in the intake pipe of the engine is lower than a first predetermined value and a second signal produced when the engine speed is lower than a second predetermined value. The first and second predetermined values are set such that they are incompatible with each other during normal operation of the engine. The control system includes an air/fuel ratio control system which is provided with means responsive to the above trouble-indicative signal to carry out at least one of actions of moving an air/fuel ratio control valve actuator to a predetermined position and holding the same thereat, giving the alarm and memorizing and displaying of a corresponding failure code.

6 Claims, 2 Drawing Figures

1
2
3
4
5
6
7₁
7₂
8₁
8₂
8₃
8₄
9
10
10a
11
11a
12
13
14
15
16
17
18
20
21
22
23
24
25
26
27
28
29
30₁
30₂
31
32
33
34
35
35a
36
36a
36b
37
38
39
40

CONTROL SYSTEM FOR INTERNAL COMBUSTION ENGINES, HAVING FUNCTION OF DETECTING ABNORMALITIES IN ENGINE SPEED SIGNAL DETECTING SYSTEM

BACKGROUND OF THE INVENTION

This invention relates to a control system for controlling an internal combustion engine, including an air/fuel ratio control system, and more particularly to a device provided in such system for detecting abnormalities in the engine speed detecting system.

It is generally known to detect the operating condition of an internal combustion engine, such as engine speed, load on the engine, acceleration and deceleration, on the basis of engine rpm and absolute pressure in the intake pipe of the engine, to effect control of the air/fuel ratio of an air/fuel mixture being supplied to the engine, ignition timing, engine exhaust emissions, etc.

As one of the above control systems, there has been proposed by the assignee of the present application an air/fuel ratio control system for performing feedback control of the air/fuel ratio of an air/fuel mixture being supplied to an internal combustion engine, which comprises an $O_2$ sensor for detecting the concentration of oxygen present in exhaust gases emitted from the engine, a carburetor for producing the mixture being supplied to the engine, and means operatively connecting the $O_2$ sensor with the carburetor in a manner effecting feedback control operation to control the air/fuel ratio of the mixture to a predetermined value, the connecting means comprising an electrical circuit, an air/fuel ratio control valve and a pulse motor for driving the air/fuel ratio control valve in response to an output signal produced by the $O_2$ sensor.

The above proposed control system is provided with an engine speed signal detecting system comprising a pressure sensor for detecting pressure in the intake pipe of the engine, and an rpm sensor for detecting the engine rpm.

In the event that these sensors produce abnormal outputs owing to failure or the like, it is impossible to properly effect control of the engine on the basis of the outputs of these sensors. Particularly in the above air/fuel ratio control system proposed by the present assignee, the engine is controlled in different manners depending upon the rotational speed of the engine and load on the engine. For instance, the control of the engine includes open loop control which comprises controlling the air/fuel ratio of the mixture to respective predetermined values suitable for various engine operating conditions such as wide-open-throttle, engine idle and engine deceleration when these operating conditions are detected on the basis of the pressure in the intake pipe or the engine rpm, and closed loop control which comprises controlling the mixture air/fuel ratio to a proper predetermined value in immediate response to changes in the output of the $O_2$ sensor when engine partial load is detected on the basis of the above factors. It goes without saying that in such control system, accurate air/fuel control cannot be carried out in the event of a failure in the pressure sensor or engine speed sensor of the engine speed signal detecting system.

OBJECTS AND SUMMARY OF THE INVENTION

It is an object of the invention to provide a control system for controlling an internal combustion engine, which is provided with a fail safe function of detecting an abnormality in the engine speed signal detecting system and taking suitable actions upon detection of the abnormality.

It is another object of the invention to provide an air/fuel ratio control system for an internal combustion engine, which is adapted to take at least one of actions of setting an air/fuel ratio control valve actuator to a predetermined position for prevention of the mixture air/fuel ratio from being controlled to an improper value, giving the alarm, and memorizing and displaying a corresponding failure code, upon occurrence of an abnormality in the engine speed signal detecting system.

According to the invention, there is provided a control system for controlling an internal combustion engine, which comprises: a first sensor for detecting pressure in the intake pipe of the engine; a second sensor for detecting the rotational speed of the engine; an intake pipe pressure determining circuit adapted to produce a first signal when a value of the pressure in the intake pipe detected by the first sensor is lower than a first predetermined value; an engine speed determining circuit adapted to produce a second signal when a value of the rotational speed of the engine detected by the second sensor is lower than a second predetermined value; and a timer adatpted to produce a third signal when there is a concurrence of the first and second signals lasting for a predetermined period of time. The above first and second predetermined values are set such that they are incompatible with each other when the engine is in a normal operating state.

The control system for an internal combustion engine according to the invention includes an air/fuel ratio control system for performing feedback control of the air/fuel ratio of an air/fuel mixture being supplied to an internal combustion engine, which comprises: an $O_2$ sensor for detecting the concentration of oxygen present in exhaust gases emitted from the engine; a carburetor for producing the mixture being supplied to the engine; and means operatively connecting the $O_2$ sensor with the carburetor in a manner effecting feedback control operation to control the air/fuel ratio of the mixture to a predetermined value and comprising an electrical circuit, an air/fuel ratio control valve and a pulse motor for driving the air/fuel ratio control valve in response to an output signal produced by the $O_2$ sensor. The above electrical circuit includes means for stopping the pulse motor upon concurrence of the first and second signals, and means responsive to the third signal to execute at least one of actions of setting the pulse motor to a predetermined position, giving the alarm of the abnormality, and memorizing and displaying a failure code corresponding to an existing failure.

The above and other objects, features and advantages of the invention will be more apparent from the ensuing detailed description taken in connection with the accompanying drawings in which:

DETAILED DESCRIPTION

Details of the air/fuel ratio control system according to the invention will now be described by reference to the accompanying drawings wherein an embodiment of the invention is illustrated.

Figure 1:
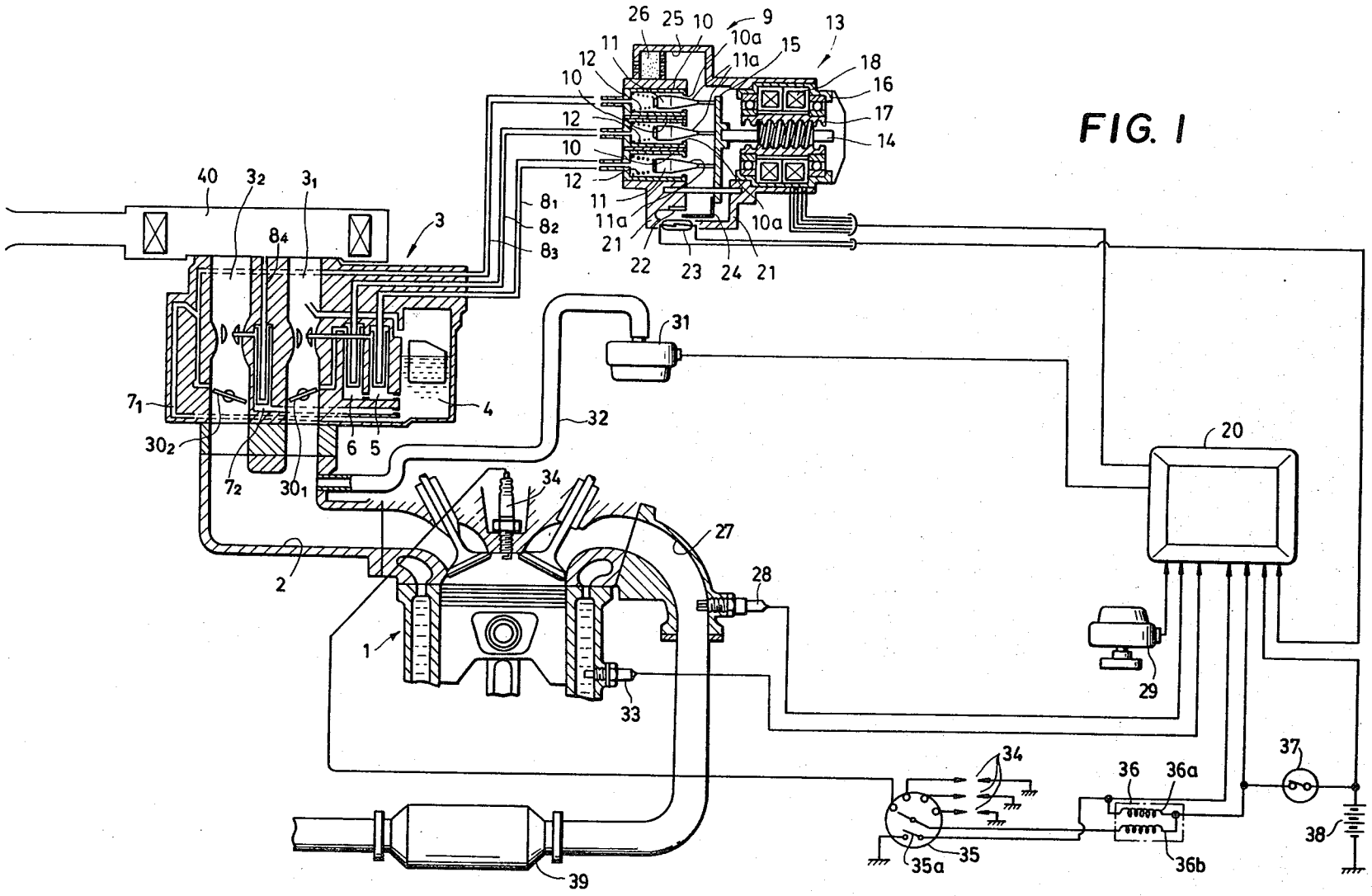
FIG. 1 is a diagrammatic view illustrating the whole arrangement of an air/fuel ratio control system given as an embodiment of the invention.

Referring first to FIG. 1, there is illustrated the whole system of the invention. Reference numeral 1 designates an internal combustion engine. Connected to the engine 1 is an intake manifold 2 which forms the intake pipe of the engine 1 and is provided with a carburetor generally designated by the numeral 3. The carburetor 3 has fuel passages 5, 6 which communicate a float chamber 4 with the primary bore $3_1$ of the carburetor 3. These fuel passages 5, 6 are connected to an air/fuel ratio control valve generally designated by the numeral 9, via air bleed passages $8_1$, $8_2$. The carburetor 3 also has fuel passages $7_1$, $7_2$ communicating the float chamber 4 with the secondary bore $3_2$ of the carburetor 3. The fuel passage $7_1$, on one hand, is connected to the above air/fuel ratio control valve 9 via an air passage $8_3$ and, on the other hand, opens in the secondary bore $3_2$ at a location slightly upstream of a throttle valve $30_2$ in the secondary bore. The fuel passage $7_2$ communicates with the interior of an air cleaner 40 via an air passage $8_4$ having a fixed orifice. The control valve 9 is comprised of three flow rate control valves, each of which is formed of a cylinder 10, a valve body 11 displaceably inserted into the cylinder 10, and a coil spring 12 interposed between the cylinder 10 and the valve body 11 for urging the valve body 11 in a predetermined direction. Each valve body 11 is tapered along its end portion 11*a* remote from the coil spring 12 so that the effective opening area of the opening 10*a* of each cylinder 10, in which the tapered portion 11*a* of the valve body is inserted, varies as the valve body 11 is moved. Each valve body 11 is disposed in urging contact with a connection plate 15 coupled to a worm element 14 which is axially movable but not rotatable about it own axis. The worm element 14 is in threaded engagement with the rotor 17 of a pulse motor 13 which is arranged about the element 14 and rotatably supported by radial bearings 16. Arranged about the rotor 17 is a solenoid 18 which is electrically connected to an electronic control unit (hereinafter called "ECU") 20. The solenoid 18 is energized by driving pulses supplied from ECU 20 to cause rotation of the rotor 17 which in turn causes movement of the worm element 14 threadedly engaing the rotor 17 in the leftward and rightward directions as viewed in FIG. 1. Accordingly, the connection plate 15 coupled to the worm element 14 is moved leftward and rightward in unison with the movement of the worm element 14.

The pulse motor 13 has its stationary housing 21 provided with a permanent magnet 22 and a reed switch 23 arranged opposite to each other. The plate 15 is provided at its peripheral edge with a magnetic shielding plate 24 formed of a magnetic material which is interposed between the permanent magnet 22 and the reed switch 23 for movement into and out of the gap between the two members 22, 23. The magnetic shielding plate 24 is displaced in the leftward and rightward directions in unison with displacement of the plate 15 in the corresponding directions. The reed switch 23 turns on or off in response to the displacement of the plate 24. That is, when the valve body 11 of the air/fuel ratio control valve 9 passes a reference position which is determined by the positions of the permanent magnet 22, reed switch 23 and magnetic shielding plate 24, the reed switch 23 turns on or off depending upon the moving direction of the valve body 11, to supply a corresponding binary output signal to ECU 20.

Incidentally, the pulse motor housing 21 is formed with an air intake 25 communicating with the atmosphere. Air is introduced through a filter 26 mounted in the air intake 25, into each flow rate control valve in the housing 21.

On the other hand, an $O_2$ sensor 28, which is made of zirconium oxide or the like, is inserted in the inner peripheral wall of the exhaust manifold 27 of the engine 1 in a manner partly projecting in the manifold 27. The sensor 28 is connected to ECU 20 to supply its output thereto. An atmospheric pressure sensor 29 is provided to detect the ambient atmospheric pressure surrounding the vehicle, not shown, in which the engine 1 is installed. The sensor 29 is also connected to ECU 20 to supply its output thereto.

An ignition plug 34 is embedded in the cylinder head of the engine 1 with its tip projected in the combustion chamber within the engine cylinder. The plug 34, which is one of a plurality of ignition plugs provided in a plurality of engine cylinders, is electrically connected to a distributor 35 which is arranged to distribute high voltage current alternately to the ignition plugs of the engine cylinders. Electrically connected to the distributor 35 is an ignition coil 36 which in turn is electrically connected to a battery 38 by way of an ignition switch 37. In the illustrated embodiment, the ignition switch 37 and the battery 38 also serve as the power switch and power supply for ECU 20, respectively. The distributor 35 is coupled to the camshaft, not shown, of the engine 1 for rotation at speeds proportional of the engine speed so that current flows in the primary coil 36*a* of the ignition coil 36 in a manner intermittently interrupted in response to switching of the contact breaker 35*a* of the distributor 35 or an output signal produced by a contactless pickup alternatively provided, to cause high voltage current in the secondary coil 36*b*, which corresponds in frequency to the above intermittent current interruption. This high voltage current is distributed to the ignition plug 34 of each of the engine cylinders. The contact breaker 35*a* and the primary coil 36*a* are electrically connected to ECU 20 to supply thereto current produced in the primary coil 36*a* intermittently due to switching of the contact breaker 35*a*. In this manner, the distributor 35 and the ignition coil 36 also serve as an engine rpm sensor.

On the other hand, a pressure sensor 31 is connected to a conduit 32 which opens at its end in the intake manifold 2 of the engine 1 at a zone downstream of the throttle valves $30_1$, $30_2$, to detect the absolute pressure in the intake manifold 2. This pressure sensor 31 is formed of a bellows displaceable in response to pressure and a potentiometer for producing a terminal voltage variable with displacement of the bellows. The pressure sensor 31 has its output electrically connected to ECU 20 to supply an output signal indicative of detected absolute pressure thereto.

Incidentally, in FIG. 1, reference numeral 33 designates a thermistor partly inserted in the peripheral wall of the engine cylinder, the interior of which is filled with engine cooling water, to detect the temperature of the cooling water as the engine temperature. The thermistor 33 is also electrically connected to ECU 20 to supply its output signal thereto. Reference numeral 39 denotes a three-way catalyst arranged across the exhaust output for purifying ingredients of HC, CO and NOx in exhaust gases emitted from the engine 1.

Details of the air/fuel ratio control which can be performed by the air/fuel ratio feedback control system of the invention described above will now be described with reference to FIG. 1 which has been referred to hereinabove.

Initialization

Referring first to the initialization, when the ignition switch 37 in FIG. 1 is set on at the start of the engine, ECU 20 is initialized to detect the reference position of the actuator or pulse motor 13 by means of the reed switch 23 and hence drive the pulse motor 13 to set it to its best position (a preset position) for starting the engine, that is, set the initial air/fuel ratio to a predetermined proper value. The above preset position of the pulse motor 13 is hereinafter called "$PS_{CR}$". This setting of the initial air/fuel ratio is made on condition that the engine rpm Ne is lower than a predetermined value $N_{CR}$ (e.g., 400 rpm) and the engine is in a condition before firing. The predetermined value $N_{CR}$ is set at a value higher than the cranking rpm and lower than the idling rpm.

The above reference position of the pulse motor 13 is detected as the position at which the reed switch 23 turns on or off, as previously mentioned with reference to FIG. 1.

Then, ECU 20 monitors the condition of activation of the $O_2$ sensor 28 and the coolant temperature Tw detected by the thermistor 33 to determine whether or not the engine is in a condition for initiation of the air/fuel ratio control. For accurate air/fuel ratio feedback control, it is a requisite that the $O_2$ sensor 28 is fully activated and the engine is in a warmed-up condition. The $O_2$ sensor 28, which is made of stabilized zirconium dioxide or the like, has a characteristic that its internal resistance decreases as its temperature increases. If the $O_2$ sensor is supplied with electric current through a resistance having a suitable resistance value from a constant-voltage regulated power supply provided within ECU 20, the electrical potential or output voltage of the sensor initially shows a value close to the power supply voltage (e.g., 5 volts) when the sensor is not activated, and then, its electrical potential lowers with the increase of its temperature. Therefore, according to the invention, the air/fuel ratio feedback control is not initiated until after the conditions are fulfilled that the sensor produces an activation signal when its output voltage lowers down to a predetermined voltage Vx, a timer finishes counting for a predetermined period of time $t_x$ (e.g., 1 minute) starting from the occurrence of the above activation signal, and the coolant temperature Tw increases up to a predetermined value Twx at which the automatic choke is opened to an opening for enabling the air/fuel ratio feedback control.

During the above stage of the detection of activation of the $O_2$ sensor and the coolant temperature Tw, the pulse motor 13 is held at its predetermined position $PS_{CR}$. The pulse motor 13 is driven to appropriate positions in response to the operating condition of the engine after initiation of the air/fuel ratio control, as hereinlater described.

Basic Air/Fuel Ratio Control

Following the initialization, the program proceeds to the basic air/fuel ratio control.

ECU 20 is responsive to various detected value signals representing the output voltage of the $O_2$ sensor 28, the absolute pressure in the intake manifold 2 detected by the pressure sensor 31, the engine rpm Ne detected by the rpm sensor 35, 36, and the atmospheric pressure $P_A$ detected by the atmospheric pressure sensor 29, to drive the pulse motor 13 as a function of these signals to control the air/fuel ratio. More specifically, the basic air/fuel ratio control comprises open loop control which is carried out at wide-open-throttle, at engine idle, and at engine deceleration, and closed loop control which is carried out at engine partial load. All the control is initiated after completion of the warming-up of the engine.

First, the condition of open loop control at wide-open-throttle is met when the differential pressure $P_A-P_B$ (gauge pressure) between the absolute pressure $P_B$ detected by the pressure sensor 31 and the atmospheric pressure $P_A$ (absolute pressure) detected by the atmospheric pressure sensor 29 is lower than a predetermined value $\Delta P_{WOT}$. ECU 20 compares the difference in value between the output signals of the sensors 29, 31 with the predetermined value $\Delta P_{WOT}$ stored therein, and when the relationship of $P_A-P_B<\Delta P_{WOT}$ stands, drives the pulse motor 13 to a predetermined position (preset position) $PS_{WOT}$ and holds it there, which is a position best appropriate for the engine emissions to be obtained at the time of termination of the wide-open-throttle open loop control. At wide-open-throttle, a known economizer, not shown, or the like is actuated to supply a rich or small air/fuel ratio mixture to the engine.

The condition of open loop control at engine idle is met when the engine rpm Ne is lower than a predetermined idle rpm $N_{IDL}$ (e.g., 1,000 rpm). ECU 20 compares the output signal value Ne of the rpm sensor 35, 36 with the predetermined rpm $N_{IDL}$ stored therein, and when the relationship of $Ne<N_{IDL}$ stands, drives the pulse motor 13 to a predetermined idle position (preset position) $PS_{IDL}$ which is best suitable for the engine emissions and holds it there.

The above predetermined idle rpm $N_{IDL}$ is set at a value slightly higher than the actual idle rpm to which the engine concerned is adjusted.

The condition of open loop control at engine deceleration is fulfilled when the absolute pressure $P_B$ in the intake manifold is lower than a predetermined value $PB_{DEC}$. ECU 20 compares the output signal value $P_B$ of the pressure sensor 31 with the predetermined value $PB_{DEC}$ stored therein, and when the relationship of $P_B<PB_{DEC}$ stands, drives the pulse motor 13 to a predetermined deceleration position (preset position) $PS_{DEC}$ best suitable for the engine emissions and holds it there.

The ground for this condition of open loop control at engine deceleration lies in that when the absolute pressure $P_B$ in the intake manifold drops below the predetermined value, unburned HC is produced at an increased rate in the exhaust gases, to make it impossible to carry out the air/fuel ratio feedback control based upon the detected value signal of the $O_2$ sensor with accuracy, thus failing to control the air/fuel ratio to a theoretical value. Therefore, according to the invention, the open loop control is employed, as noted above, when the absolute pressure $P_B$ in the intake manifold detected by the pressure sensor 31 is smaller than the predetermined value $PB_{DEC}$, where the pulse motor is set to the predetermined position $PS_{DEC}$ best suitable for the engine emissions obtained at the time of termination of the deceleration open loop control. At the beginning of engine deceleration, a shot air valve, not shown, is actuated to supply air into the intake manifold to prevent the occurrence of unburned ingredients in the exhaust gases.

During operations of the above-mentioned open loop control at wide-open-throttle, at engine idle, at engine deceleration, the respective predetermined positions $PS_{WOT}$, $PS_{IDL}$, $PS_{DEC}$ for the pulse motor 13 for compensated for atmospheric pressure $P_A$, as hereinlater described.

On the other hand, the condition of closed loop control at engine partial load is met when the engine is in an operating condition other than the above-mentioned open loop control conditions. During the closed loop control, ECU 20 performs selectively feedback control based upon proportional term correction (hereinafter called "P term control") and feedback control based upon integral term correction (hereinafter called "I term control"), in response to the engine rpm Ne detected by the engine rpm sensor 35, 36 and the output signal of the $O_2$ sensor 28. To be concrete, the integral term correction is used when the output voltage of the $O_2$ sensor 28 varies only at the higher level side or only at the lower level side with respect to a reference voltage Vref, wherein the position of the pulse motor 13 is corrected by an integral value obtained by integrating the value of a binary signal which changes in dependence on whether the output voltage of the $O_2$ sensor is at the higher level or at the lower level with respect to the predetermined reference voltage Vref, to thereby achieve stable and accurate position control of the pulse motor 13. On the other hand, when the output signal of the $O_2$ sensor changes from the higher level to the lower level or vice versa, the proportional term correction is carried out wherein the position of the pulse motor 13 is corrected by a value directly proportional to a change in the output voltage of the $O_2$ sensor to thereby achieve air/fuel ratio control in a manner prompter and more efficient than the integral term correction.

As noted above, according to the above I term control, the pulse motor position is varied by an integral value by integrating the value of a binary signal corresponding to the change of the output voltage of the $O_2$ sensor. According to this I term control, the number of steps by which the pulse motor is to be displaced per second differs depending upon the speed at which the engine is then operating. That is, in a low engine rpm range, the number of steps by which the pulse motor is to be displaced is small. With an increase in the engine rpm, the above number of steps increases so that it is large in a high engine rpm range.

Whilst, according to the P term control which, as noted above, is used when there is a change in the output voltage of the $O_2$ sensor from the higher level to the lower one or vice versa with respect to the reference voltage Vref, the number of steps by which the pulse motor is to be displaced per second is set at a single predetermined value (e.g., 6 steps), irrespective of the engine rpm.

The air/fuel ratio control at engine acceleration (i.e., off-idle acceleration) is carried out when the engine rpm Ne exceeds the aforementioned predetermined idle rpm $N_{IDL}$ (e.g., 1,000 rpm) during the course of the engine speed increasing from a low rpm range to a high rpm range, that is, when the engine speed changes from a relationship $Ne < N_{IDL}$ to one $Ne \geqq N_{IDL}$. On this occasion, ECU 20 rapidly moves the pulse motor 13 to a predetermined acceleration position (preset position) $PS_{ACC}$, and thereafter initiates the aforementioned air/fuel ratio feedback control. This predetermined position $PS_{ACC}$ is compensated for atmospheric pressure $P_A$, too, as hereinlater described.

The above-mentioned predetermined position $PS_{ACC}$ is set at a position where the amount of detrimental ingredients in the exhaust gases is small. Therefore, particularly at the so-called "standing start", i.e., acceleration from a vehicle-stopping position, setting the pulse motor position to the predetermined position $PS_{ACC}$ is advantageous to anti-exhaust measures, as well as to achievement of accurate air/fuel ratio feedback control to be done following the acceleration. This acceleration control is carried out under a warmed-up engine condition, too. By thus setting the pulse motor to the preset position $PS_{ACC}$ at the standing start of the engine, it is feasible to reduce the amount of detrimental ingredients in the engine exhaust gases to be produced at the standing start. Further, this setting of the pulse motor position automatically determines the initial air/fuel ratio to be applied at the start of air/fuel ratio feedback control immediately following this standing start to thereby facilitate control of the air/fuel ratio to an optimum value for the emission characteristics and driveability of the engine at the start of air/fuel ratio feedback control.

Particularly, the above manner of control at engine acceleration enables a large reduction in the total amount of detrimental ingredients in the exhaust gases to be produced during transition from the standing start to the immediately following air/fuel ratio feedback operation, thus being advantageous to the anti-pollution measures.

In transition from the above-mentioned various open loop control to the closed loop control at engine partial load or vice versa, changeover between open loop mode and closed loop mode is effected in the following manner: First, in changing from closed loop mode to open loop mode, ECU 20 moves the pulse motor 13 to an atmospheric pressure-compensated predetermined position $PSi(P_A)$ in a manner referred to later, irrespective of the position at which the pulse motor was located immediately before entering the open loop control. This predetermined position $PSi(P_A)$ includes preset positions $PS_{CR}$, $PS_{WOT}$, $PS_{IDL}$, $PS_{DEC}$ and $PS_{ACC}$, each of which is corrected in response to actual atmospheric pressure as hereinlater referred to. Various open loop control operations can be promptly done, simply by setting the pulse motor to the above-mentioned respective predetermined positions.

On the other hand, in changing from open loop mode to closed loop mode, ECU 20 commands the pulse motor 13 to initiate air/fuel ratio feedback control with I term correction. That is, there can be a difference in timing between the change of the output signal level of the $O_2$ sensor from the high level to the low level or vice versa and the change from the open loop mode to the closed loop mode. In such an event, the deviation of the pulse motor position from the proper position upon entering the closed loop mode, which is due to such timing difference, is much smaller in the case of initiating air/fuel ratio control with I term correction than that in the case of initiating it with P term correction, to make it possible to resume early accurate air/fuel ratio control and accordingly ensure highly stable engine exhaust emission characteristics.

To obtain optimum exhaust emission characteristics irrespective of changes in the actual atmospheric pressure during open loop air/fuel ratio control or at the time of shifting from open loop mode to closed loop mode, the position of the pulse motor 13 needs to be compensated for atmospheric pressure, as previously mentioned. According to the invention, the above-mentioned predetermined or preset positions $PS_{CR}$, $PS_{WOT}$, $PS_{IDL}$, $PS_{DEC}$, $PS_{ACC}$ at which the pulse motor 13 is to be held during the respective open loop control operations are corrected in a linear manner as a function of changes in the atmospheric pressure $P_A$, using the following equation:

$$PSi(P_A)=PSi+(760-P_A)\times Ci$$

where i represents any one of CR, WOT, IDL, DEC and ACC, accordingly PSi represents any one of $PS_{CR}$, $PS_{WOT}$, $PS_{IDL}$, $PS_{DEC}$ and $PS_{ACC}$ at 1 atmospheric pressure (=760 mmHg), and Ci a correction coefficient, representing any one of $C_{CR}$, $C_{WOT}$, $C_{IDL}$, $C_{DEC}$ and $C_{ACC}$. The values of PSi and Ci are previously stored in ECU 20.

ECU 20 applies to the above equation the coefficients PSi, Ci which are determined at proper different values according to the kinds of open loop control to be carried out, to calculate by the above equation the position $PSi(P_A)$ for the pulse motor 13 to be set at a required kind of open loop control and moves the pulse motor 13 to the calculated position $PSi(P_A)$, as will be described in detail hereinlater.

By correcting the air/fuel ratio during open loop control in response to the actual atmospheric pressure in the above-mentioned manner, it is possible to obtain not only conventionally known effects such as best driveability and prevention of burning of the ignition plug in an engine cylinder, but also optimum emission characteristics by setting the value of Ci at a suitable value, since the pulse motor position held during open loop control forms an initial position upon entering subsequent closed loop control.

The position of the pulse motor 13 which is used as the actuator for the air/fuel ratio control valve 9 is monitored by a position counter provided within ECU 20. However, there can occur a disagreement between the counted value of the position counter and the actual position of the pulse motor due to skipping or racing of the pulse motor. In such an event, ECU 20 operates on the counted value of the position counter as if it were the actual position of the pulse motor 13. However, this can impeded proper setting of the air/fuel ratio during open loop control where the actual position of the pulse motor 13 must be accurately recognized by ECU 20.

Figure 2:
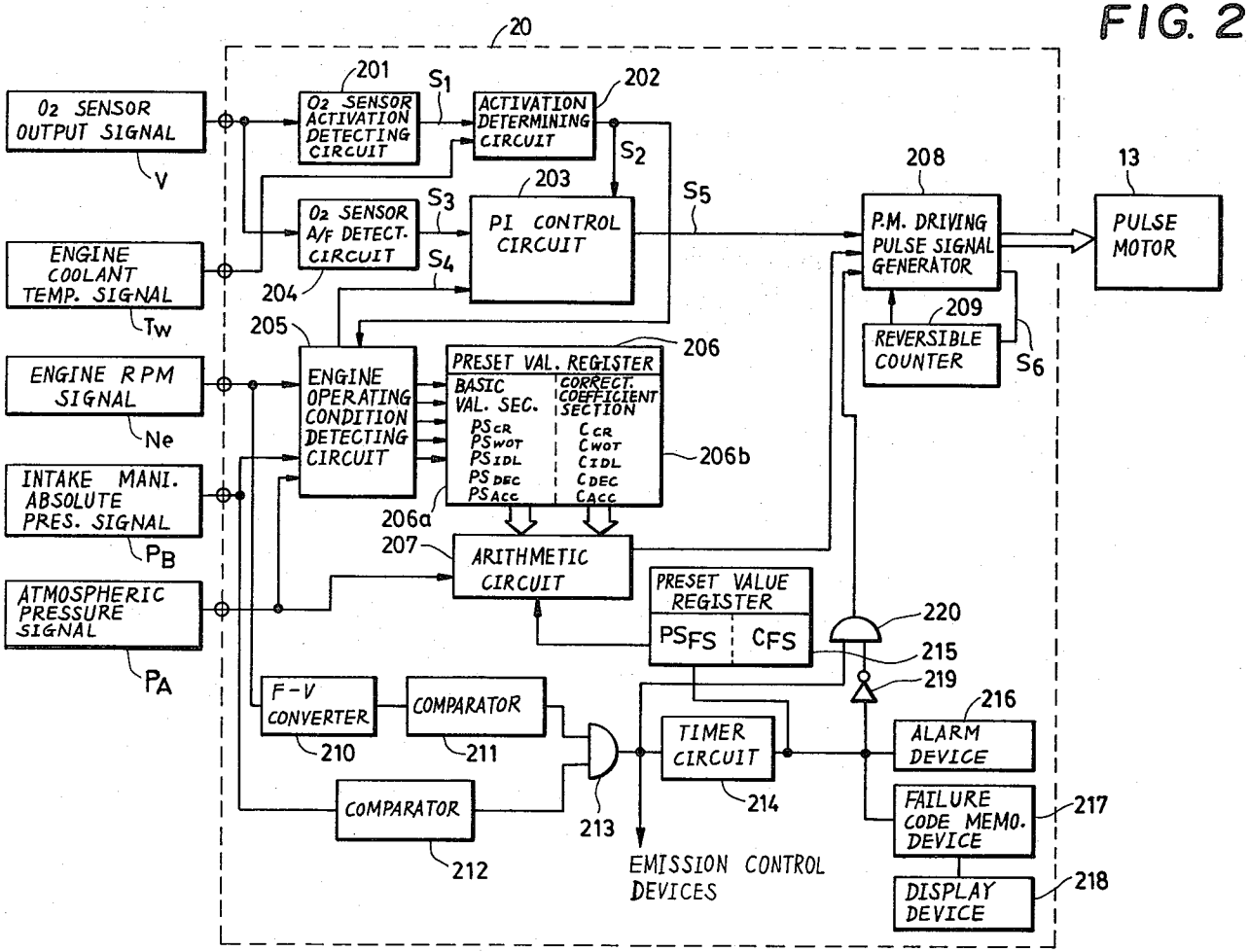
FIG. 2 is a block diagram illustrating an electrical circuit provided in the electronic control unit in FIG. 1, which is provided with engine rotational speed detecting and fail safe functions.

In view of the above disadvantage, as previously mentioned, according to the air/fuel ratio control system of the invention, in addition to detection of the initial position of the pulse motor 13 by regarding as the reference position (e.g., 50th step) the position of the pulse motor at which the reed switch 23 turns on or off when the pulse motor is driven, which was previously noted with reference to the initialization in FIG. 2, the position counter has its counted value replaced by the number of steps corresponding to the reference position (e.g., 50 steps) stored in ECU 20 upon the pulse motor 13 passing the switching point of the reed switch 23, to thus ensure high reliability of subsequent air/fuel ratio control.

It will be noted from the foregoing description that the determination of various open loop control conditions is made mainly on the basis of the outputs of the engine rpm sensor 35, 36 and the pressure sensor 31. However, these sensors can be inoperative due to failure in the sensors per se or in ECU 20 or disconnection fault. If the air/fuel ratio control operation is continued even in such an event, an improper air/fuel ratio is obtained due to abnormal output of a defective sensor. According to the invention, in case of such an accident, the control system is arranged such that when the output of the rpm sensor 35, 36 shows a value lower than a predetermined value (e.g., 400 rpm) and simultaneously the output of the pressure sensor 31 shows a value lower than a predetermined value (e.g., 200 mmHg (absolute pressure)), the pulse motor 13 is immediately stopped on the spot. Further if this condition of low engine speed and low absolute pressure continues for a period of time sufficient for accurate determination of occurrence of a trouble, e.g., 2 seconds, the pulse motor 13 is moved to a predetermined position $PS_{FS}$ which may be compensated for atmospheric pressure if required, and held there, on the assumption that an abnormality occurs in the engine speed signal detecting system. At the same time, necessary actions are taken such as giving warning and memorization and display of a corresponding failure code.

The above predetermined value of the output of the rpm sensor 35, 36 and the above predetermined value of the output of the pressure sensor 31 are set such that they are not compatible with each other under a normal operating state of the engine.

As noted above, by way of an example, the former value is set at 400 rpm, and the latter one at 200 mmHg, respectively. That is, when the engine rpm is lower than 400 rpm, there can never occur sufficient negative pressure in the intake pipe of the engine, that is, the absolute pressure in the intake pipe can never be lower than 200 mmHg. Thus, the two conditions cannot be not fulfilled at the same time. If they are fulfilled concurrently, this means the occurrence of an abnormality in the system of detection of these factors.

FIG. 2 is a block diagram illustrating the interior construction of an electrical circuit provided within ECU 20 used in the air/fuel ratio control system of the invention described above, for performing the basic air/fuel ratio control operation. In ECU 20, reference numeral 201 designates a circuit for detecting the activation of the $O_2$ sensor 28, which is supplied at its input with an output signal V from the $O_2$ sensor. Upon passage of the predetermined period of time Tx after the voltage of the above output signal V has dropped below the predetermined value Vx, the above circuit 201 supplies an activation signal $S_1$ to an activation determining circuit 202. This activation determining circuit 202 is also supplied at its input with an engine coolant temperature signal Tw from the thermistor 33 in FIG. 1. When supplied with both the above activation signal $S_1$ and the coolant temperature signal Tw indicative of a value exceeding the predetermined value Twx, the activation determining circuit 202 supplies an air/fuel ratio control initiation signal $S_2$ to a PI control circuit 203 to render same ready to operate. Reference numeral 204 represents an air/fuel ratio determining circuit which determines the value of air/fuel ratio of engine exhaust gases, depending upon whether or not the output voltage of the $O_2$ sensor is larger than the predetermined value Vref, to supply a binary signal $S_3$ indicative of the value of air/fuel ratio thus obtained, to the PI control circuit 203. On the other hand, an engine operating condition detecting circuit 205 is provided in ECU 20, which is supplied with an engine rpm signal Ne from the engine rpm sensor 35, 36, an absolute pressure signal $P_B$ from the pressure sensor 31, an atmospheric pressure $P_A$ from the atmospheric pressure sensor 29, all the sensors being shown in FIG. 1, and the above control initiation signal $S_2$ from the activation determining circuit 202 in FIG. 3, respectively. The circuit 205 supplies a control signal $S_4$ indicative of a value corresponding to the values of the above input signals to the PI control circuit 203. The PI control circuit 203 accordingly supplies to a pulse motor driving pulse signal generator 208 a pulse motor control signal $S_5$ having a value corresponding to the air/fuel ratio signal $S_3$ from the air/fuel ratio determining circuit 204 and a signal component corresponding to the engine rpm Ne in the control signal $S_4$ supplied from the engine operating condition detecting circuit 205. The engine operating condition detecting circuit 205 also supplies to the PI control circuit 203 the above control signal $S_4$ containing a signal component corresponding to the engine rpm Ne, the absolute pressure $P_B$ in the intake manifold, atmospheric pressure $P_A$ and the value of air/fuel ratio control initiation signal $S_2$. When supplied with the above signal component from the engine operating condition detecting circuit 205, the PI control circuit 203 interrupts its own operation. Upon interruption of the supply of the above signal component to the control circuit 203, a pulse signal $S_5$ is outputted from the circuit 203 to the pulse motor driving pulse signal generator 208, which signal starts air/fuel ratio control with integral term correction.

On the other hand, a preset value register 206 is provided in ECU 20, which comprises a basic value register section 206*a* in which are stored the basic values of preset values $PS_{CR}$, $PS_{WOT}$, $PS_{IDL}$, $PS_{DEC}$ and $PS_{ACC}$ for the pulse motor position, applicable to various engine conditions, and a correcting coefficient register section 206*b* in which are stored atmospheric pressure correcting coefficients $C_{CR}$, $C_{WOT}$, $C_{IDL}$, $C_{DEC}$ and $C_{ACC}$ for these basic values. The engine operating condition detecting circuit 205 detects the operating condition of the engine on the basis of the activation of the $O_2$ sensor and the values of engine rpm Ne, intake manifold absolute pressure $P_B$ and atmospheric pressure $P_A$ to read from the register 206 the basic value of a preset value corresponding to the detected operating condition of the engine and its corresponding correcting coefficient and apply same to an arithmetic circuit 207. The arithmetic circuit 207 performs arithmetic operation responsive to the value of the atmospheric pressure signal $P_A$, using the equation $PSi(P_A)=PSi+(760-P_A)\times Ci$. The resulting preset value is applied to the pulse motor driving pulse signal generator 208. Connected to the pulse motor driving pulse signal generator 208 is a reversible counter 209 which is supplied with a signal $S_6$ in the form of pulses outputted from the generator 208 to count the pulses as the actual position of the pulse motor 13. Subsequently, when the $O_2$ sensor 28 remains inactive, an atmospheric pressure-compensated preset value $PS_{CR}(P_A)$ is outputted from the arithmetic circuit 207 to the pulse motor driving pulse signal generator 208. The generator 208 is also supplied with a counted value from the reversible counter 209 and therefore supplies a driving signal corresponding to the difference between the preset value $PS_{CR}(P_A)$ and the counted value supplied from the reversible counter to the pulse motor 13 to thereby achieve accurate control of the position of the same. Also when the other open loop control conditions are detected by the engine operative condition detecting circuit 205, similar operation to that just mentioned above are carried out.

In FIG. 2, the group of elements indicated by reference numerals 210 through 220 form a block for execution of a function of detecting an abnormality in the engine speed signal detecting system and a fail safe function.

An F-V (frequency-to-voltage) converter 210 is connected at its input to the engine rmp sensor 35, 36 appearing in FIG. 1 to be supplied with an engine rpm signal Ne therefrom. The converter 210 is adapted to supply an output voltage corresponding to the engine rpm Ne to a comparator 211 which cooperates with the converter 210 to form an engine rpm determining circuit. The comparator 211 has its output connected to one input terminal of an AND circuit 213. The comparator 211 compares the output voltage of the converter 210 with a reference voltage outputted from a reference voltage source provided therein (e.g., a voltage corresponding to 400 rpm) to supply a binary signal corresponding to the relationship between the two voltages to the AND circuit 213. On the other hand, another comparator 212, which forms an intake pipe absolute pressure determining circuit, is connected at its input to the pressure sensor 31 in FIG. 1 to be supplied with a signal $P_B$ in the form of direct current voltage, indicative of the absolute pressure in the intake manifold 2, and at its output to the other input terminal of the AND circuit 213, respectively. The comparator 212 compares the absolute pressure signal $P_B$ with a reference voltage outputted from a reference voltage source provided therein (e.g., a voltage corresponding to 200 mmHg) to supply a binary signal corresponding to the relationship between the two voltages to the AND circuit 213. The AND circuit 213 has its output terminal connected to the input of a timer circuit 214. This timer circuit 214 is adapted to produce a binary output of 0 for a predetermined period of time, e.g., 2 seconds, since it is supplied with a binary signal of 1 from the AND circuit 213. That is, it produces a binary output of 1 when the above predetermined period of time lapses after application of the above binary signal of 1 thereto. The timer circuit 214 has its output connected to a preset value register 215, an alarm device 216 and a failure code memorizing device 217, and also connected to the pulse motor driving pulse signal generator 208 by way of an inverter 219 and an AND circuit 220. A display device 218 is connected to the failure code memorizing device 217. On the other hand, the AND circuit 213 has its output terminal directly commected to one input terminal of the AND circuit 220 other than one connected to the inverter 219.

The operation of the above block for execution of an engine speed signal abnormality detecting function and a fail safe function will now be explained. The comparators 211, 212 are adapted to produce binary outputs of 1, respectively, when the engine rpm signal Ne shows a value lower than the predetermined value or 400 rpm for instance and when the intake pipe absolute pressure signal $P_B$ shows a value lower than the predetermined value or 200 mmHg for instance. Therefore, the comparators 211, 212 both produce binary outputs of 1 to cause the AND circuit 213 to produce a binary output of 1 when the engine rpm signal Ne supplied to the comparator 211 via the F-V converter 210 has a voltage value lower than the reference voltage corresponding to 400 rpm and simultaneously the intake pipe absolute pressure signal $P_B$ has a voltage value lower than the reference voltage corresponding to 200 mmHg. The high output of the AND circuit 213 is, on one hand, applied to one input terminal of the AND circuit 220 and, on the other hand, to the timer circuit 214. Until the predetermined period of time (2 seconds) lapses after application of the above binary output of 1 to the timer circuit 214, this circuit 214 produces a binary output of 0 so that before the lapse of this predetermined period of time the AND circuit 220 has its other input terminal supplied with a binary signal of 1 as a trouble-indicative signal which is inverted by the inverter 219 from the timer circuit 214. Accordingly, the AND circuit 220 produces a binary output of 1 and applies it to the pulse motor driving pulse signal generator 208 to cause immediate stopping of the pulse motor 13. After the lapse of the above predetermined period of time (2 seconds), that is, when the condition in which the values of the signals Ne, $P_B$ are both lower than the respective predetermined values lasts over the predetermined period of time, the timer circuit 214 produces a binary output of 1. Accordingly, the output of the AND circuit 220 turns low and simultaneously the preset value register 215 is triggered by the high output of the timer circuit 214 to shift a predetermined value $PS_{FS}$ indicative of a predetermined pulse motor position to the arithmetic circuit 207. The arithmetic circuit 207 in turn supplies this preset value $PS_{FS}$ to the pulse motor driving pulse signal generator 208. The preset value $PS_{FS}$ may be corrected with a coefficient $C_{FS}$ in response to the atmospheric pressure signal $P_A$, at the arithmetic circuit 207. The driving pulse signal generator 208 compares a counted value indicative of the actual position of the pulse motor, outputted from the reversible counter 209 with the preset value $PS_{FS}$ and drives the pulse motor 13 by steps corresponding to the difference between the two valves to stop it at a position corresponding to the preset value.

Simultaneously with the above operation, the output of 1 of the timer circuit 214 causes actuation of the alarm device 216, the failure code memorizing circuit 217 and the display device 218 to perform respective operations of giving the alarm of the abnormality, memorizing a failure code corresponding to an existing failure and displaying the failure code.

Further, the output of 1 of the AND circuit 213 is supplied as an operation interrupting signal to various exhaust emission control devices (exhaust gas recirculation valve (EGR valve), secondary air valve, shot air valve, etc.), not shown, to stop the operations of these devices and hold them at their respective safe positions.

What is claimed is:

1. A control system for controlling an internal combustion engine having an intake pipe, which comprises: a first sensor for detecting pressure in said intake pipe of said engine to produce an output indicative of said pressure; a second sensor for detecting the rotational speed of said engine to produce an output indicative of said rotational speed; a first circuit responsive to said output of said first sensor for producing a first signal when the value of said output of said first sensor is smaller than a first predetermined value; a second circuit responsive to said output of said second sensor for producing a second signal when the value of said output of said second sensor is smaller than a second predetermined value; and a timer associated with said first circuit and said second circuit, for producing a third signal when there is concurrence of said first signal and said second signal lasting for a predetermined period of time; wherein said first predetermined value and said second predetermined value are set such that they are incompatible with each other when said engine is in a normal operating state.

2. An air/fuel ratio control system for performing feedback control of the air/fuel ratio of an air/fuel mixture being supplied to an internal combustion engine having an intake pipe, which comprises: an $O_2$ sensor for detecting the concentration of oxygen present in exhaust gases emitted from said engine; a carburetor for producing said mixture being supplied to said engine; means operatively connecting said $O_2$ sensor with said carburetor in a manner effecting feedback control operation to control the air/fuel ratio of said mixture to a predetermined value, said connecting means including an electrical circuit, a valve adapted to vary the air/fuel ratio of said mixture, and a pulse motor responsive to a signal outputted from said electrical circuit to drive said valve; a first sensor for detecing pressure in said intake pipe of said engine to produce an output indicative of said pressure; and a second sensor for detecting the rotational speed of said engine to produce an output indicative of said rotational speed; said electrical circuit including a first circuit responsive to said output of said first sensor for producing a first signal when the value of said output of said first sensor is smaller than a first predetermined value, a second circuit responsive to said output of said second sensor for producing a second signal when the value of said second sensor is smaller than a second predetermined value, a timer associated with said first circuit and said second circuit for producing a third signal when there is a concurrence of said first signal and said second signal lasting for a predetermined period of time, and means actuatable by said third signal, wherein said first predetermined value and said second predetermined value are set such that they are incompatible with each other when said engine is in a normal operating state.

3. The air/fuel ratio control system as claimed in claim 2, wherein said electrical circuit further includes means for stopping said pulse motor upon concurrence of said first signal and said second signal.

4. The air/fuel ratio control system as claimed in claim 2, wherein said third signal-actuatable means includes means for giving the alarm of an existing abnormality.

5. The air/fuel ratio control system as claimed in claim 2, wherein said third signal-actuatable means includes means for memorizing and displaying a failure code corresponding to an existing failure.

6. The air/fuel ratio control system as claimed in claim 2, wherein said third signal-actuatable means includes means for moving said pulse motor to a predetermined position and holding same there.

* * * * *